US007033035B2

(12) United States Patent
Fatemi et al.

(10) Patent No.: US 7,033,035 B2
(45) Date of Patent: Apr. 25, 2006

(54) PORTABLE LIGHT-EMITTING DISPLAY DEVICE

(75) Inventors: John M. Fatemi, Potomac Falls, VA (US); Chin Kuo (Phily) Chung, Chung Ho (TW); Hsin Yu (Michael) Chao, Taipei County (TW)

(73) Assignee: I & K Trading, Vienna, VA (US)

( * ) Notice: Subject to any disclaimer, the term of this patent is extended or adjusted under 35 U.S.C. 154(b) by 0 days.

(21) Appl. No.: 10/471,949

(22) PCT Filed: Mar. 12, 2003

(86) PCT No.: PCT/US03/07466

§ 371 (c)(1),
(2), (4) Date: Sep. 16, 2003

(87) PCT Pub. No.: WO03/079408

PCT Pub. Date: Sep. 25, 2003

(65) Prior Publication Data

US 2004/0145886 A1 Jul. 29, 2004

Related U.S. Application Data

(60) Provisional application No. 60/363,769, filed on Mar. 12, 2002.

(51) Int. Cl.
*F21V 21/30* (2006.01)

(52) U.S. Cl. ..... 362/35; 362/272; 362/286; 362/800; 362/806; 40/502

(58) Field of Classification Search ..... 362/35, 362/251, 269, 272, 286, 386, 800, 806, 812; 40/502

See application file for complete search history.

(56) References Cited

U.S. PATENT DOCUMENTS 6,175,354 B1 * 1/2001 Blissett et al. ..... 362/35

* cited by examiner

*Primary Examiner*—Stephen Husar
(74) *Attorney, Agent, or Firm*—Stroock & Stroock & Lavan LLP

(57) ABSTRACT

A portable light-emitting display device having one or more rotating members including one or more light sources mounted or otherwise affixed thereto. The one or more rotating members are coupled to a motor. The motor and the light sources are each electrically coupled to one or more controllers, which control the speed at which the motor rotates the one or more rotating members and controls a lighting frequency and/or an intensity of all or one or more of the light sources or any combination thereof, to create a visual effect.

13 Claims, 4 Drawing Sheets

PORTABLE LIGHT-EMITTING DISPLAY DEVICE

CROSS REFERENCE TO RELATED APPLICATIONS

This application claims the benefit of U.S. Provisional Application No. 60/363,769, filed on Mar. 12, 2002, which is incorporated herein by reference.

FIELD OF THE INVENTION

The present invention relates to a portable light-emitting display that is capable of creating unique and/or pleasing visual effects.

BACKGROUND OF THE INVENTION

Light-emitting display devices have taken many shapes, forms, and styles over the years. One purpose of such devices is to capture the imagination of children. Although children can use a standard flashlight as a toy, the novelty will wear off quickly due, in large measure, to the absence of uses that are meaningful to a child. Another purpose of such devices is to create a unique visual display that is easily recognizable from a distance or at night.

The use of hand-held lighted wands, twirlers, and lighted kinematic displays is known in the prior art. Such prior art devices are described in U.S. Pat. Nos. 5,030,160; 5,041,947; 5,190,491; 5,302,965; 5,321,591; and 5,422,796.

As illustrated by the background art, efforts are continuously being made to attempt to improve light display devices. No prior effort, however, provides the benefits attendant with the present invention. Additionally, the prior patents and commercial techniques do not suggest the present inventive combination of component elements arranged and configured as disclosed and claimed herein.

Therefore, it can be appreciated that there exists a continuing need for an improved light display device that provides distinct and unique visual effects, thereby enhancing the play value of the device when used as an amusement toy or enhancing its use as an easily detected pattern of lights that can be used in other applications, such as distress signals. In this regard, the present invention substantially fulfills this need.

The present invention achieves its intended purposes, objects, and advantages through a new, useful, and unobvious combination of component elements, with the use of a minimum number of functioning parts, at a reasonable cost to manufacture, and by employing readily available materials.

SUMMARY OF THE INVENTION

The present invention is directed to a light-emitting display device. In particular, the present invention is directed towards a portable light-emitting display device that creates various unique visual effects by rotating a rotating member onto which are mounted a plurality of light-emitting sources.

In a preferred embodiment, the present invention comprises a handle assembly comprising a power source electrically connected to a motor. The motor is coupled to a rotating member that includes a plurality of light-emitting sources coupled thereto. The motor is electrically coupled to a controller, which is also electrically coupled to each of the light-emitting sources. In a preferred embodiment, the controller can control the rotational speed of the rotating member and/or the lighting pattern of the individual light-emitting sources on the rotating member, or any combination thereof. In a preferred embodiment, the controller is an Integrated Circuit (IC), which through predetermined timing sequences, controls the motor so as to rotate the rotating member at a plurality of speeds and which can be used to vary the lighting sequences and/or intensity of the light-emitting sources, or any combination thereof.

The light-emitting display device of the present invention provides unique and visually pleasing lighting effects to be used as, for example, an amusement toy or as a communication signal device, such as, for example, providing distress signals, or for general novelty purposes.

Accordingly, it is an object of the present invention to provide an improved light-emitting display device.

Other objects and features of the present invention will become apparent from the following detailed description, considered in conjunction with the accompanying drawing figures. It is to be understood, however, that the drawings are designed solely for the purpose of illustration and not as a definition of the limits of the invention, for which reference should be made to the appended claims.

BRIEF DESCRIPTION OF THE DRAWINGS

The drawing figures are not to scale and are merely illustrative, wherein like reference characters denote similar elements throughout the several views.

DETAILED DESCRIPTION OF THE PREFERRED EMBODIMENTS

Figure 1:
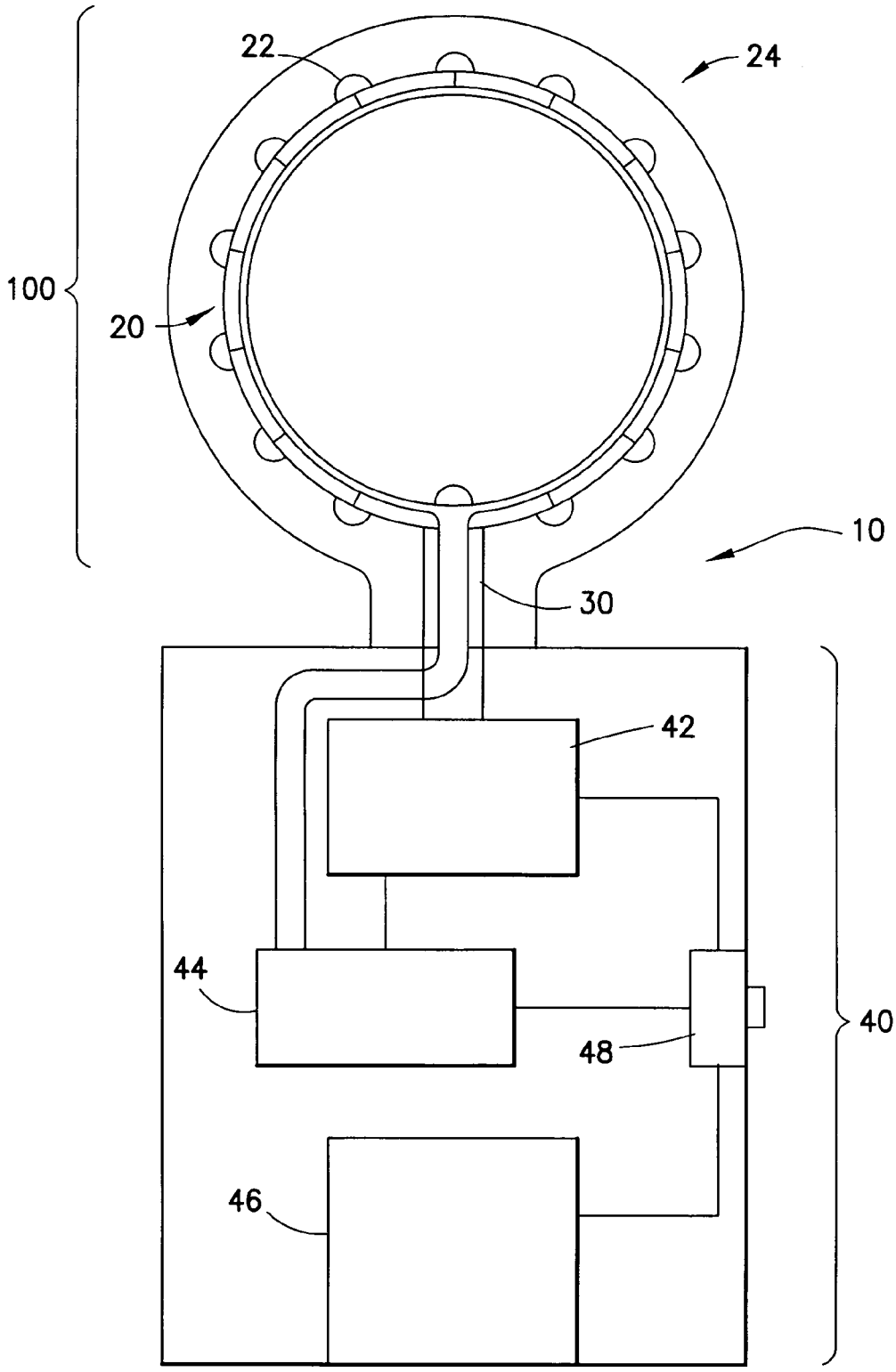
FIG. 1 is a schematic view of a portable light-emitting display device constructed in accordance with a first preferred embodiment of the present invention.

The present invention relates to a light-emitting display device that can create unique and/or visually pleasing light effects that can be used for amusement, to attract attention, communication, and/or for general novelty. In particular, the present invention is directed towards a portable light-emitting display device which creates visually pleasing lighted displays utilizing a plurality of light-emitting sources mounted or otherwise affixed at specific points along a rotating, spinning, or moving member or members.

In this respect, before describing one embodiment of the invention, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

For example, as will be further described below, the present invention is not limited to any particular type or number of rotating members or light-emitting sources, but encompasses different embodiments where the rotating members can vary in number, shape and size and the light-emitting sources can be any small light source known in the art as a matter of application-specific design choice. Specific, non-limiting examples of such light-emitting sources include, but are not limited to, light-emitting diodes (LEDs), incandescent lights, fluorescent lights, lasers, liquid crystal displays, neon lights and the like.

Similarly, the present invention is not limited to any particular type or number of controllers or power sources. The actual type and number of controllers and power sources can be varied as a matter of application-specific design choice.

In a preferred embodiment of the present invention, as seen in FIG. 1, in general terms, the portable light-emitting display device 10 comprises a handle assembly portion 40, and a light-emitting portion 100. In a preferred embodiment, the handle assembly portion 40 comprises a motor 42, a controller 44, a switch 48, and a power source 46. In a preferred embodiment, the light-emitting portion 100 comprises a rotating member 20 having a plurality of light-emitting sources 22 mounted or otherwise affixed thereon, with the rotating member 20 being enclosed within a transparent cover 24. A shaft 30 extends between the motor 42 within the handle assembly portion 40 to the rotating member 20 within the light-emitting portion 100.

The handle assembly portion 40 of the light-emitting display device 10 of this preferred embodiment will now be described in greater detail. In a preferred embodiment, the handle assembly portion 40 contains a motor 42 mechanically coupled to a shaft 30. A controller 44 is electrically coupled to the motor 42. A power supply 46, which in a preferred embodiment is comprised of one or more batteries, is electrically coupled to the motor 42. A switch 48 is electrically coupled between the motor 42 and the power supply 46. When switch 48 is engaged, it completes an electrical circuit between the power supply 46 and the motor 42, which provides power to the motor 42 and causes the rotation of the shaft 30 and the rotating member 20. The controller 44 is also electrically coupled between the power supply 46 and both the motor 42 and the light-emitting sources 22. As described in more detail below, the controller 44 can vary the speed at which the motor 42 spins or rotates the rotating member 20, and can also vary the intensity and/or timing sequences for illuminating all or one or more light-emitting sources 22, or any combination thereof.

Integrated circuits are well known in the art. In a preferred embodiment, controller 44 is an Integrated Circuit (IC) that is electrically coupled to both the motor 42 and each of the light-emitting sources 22, and which is capable of controlling both the speed of rotation of the rotating member 20 and the lighting frequency and/or light intensity of all or one or more of the light-emitting sources 22. In a preferred embodiment, the controller 44 can be any type of IC known in the art as a matter of application-specific design choice that can control the speed of rotation of the motor 42 and/or the lighting scheme of the light-emitting sources 22. In a preferred embodiment, the controller 44 is capable of controlling the intensity and/or the lighting sequence of all or one or more of light-emitting sources 22. For example, the controller 44 may illuminate all or only a select few of the light-emitting sources 22 at any particular time, or may vary the intensity of all or only a select few of the light-emitting sources 22 at any given time to provide a multitude of different visual effects. The controller 44 may also vary the rotational speed of rotating member 20 to also provide a multitude of visual effects. The controller 44 may also do both in any number of combinations to expand on the multitude of visual effects the light-emitting display device of the present invention can provide. In an alternate preferred embodiment, the controller is comprised of software or the like, which is designed to control the rotational speed of the motor and the lighting frequency and/or intensity of the light-emitting sources. In yet another alternate preferred embodiment, there is more than one controller 44 that independently controls the rotational speed of the rotating member 20 and the lighting frequency and/or light intensity of the one or more light-emitting sources 22 or combinations thereof.

The rotating member 20 comprising the light-emitting sources 22 of the present invention can take one of any number of shapes. In a preferred embodiment of the present invention, as seen in FIG. 1, the rotating member 20 is a single rotating member in the shape of a circular hoop that includes a plurality of light-emitting sources 22 mounted or otherwise affixed thereto. In this preferred embodiment, the rotating member 20 includes light-emitting sources 22 which are fourteen multi-colored light-emitting diodes (LEDs) mounted equidistant from each other along the rotating hoop 20. In this embodiment, with reference to FIG. 1, by way of example, the first LED is mounted at the bottom inner periphery of the rotating hoop 20 at the point where the hoop is coupled to the shaft 30. The remaining thirteen LEDs are mounted equidistant along the outer periphery of the rotating hoop 20. Of course, the actual number of LEDs and their particular orientation about hoop 20 can be varied as a matter of design choice. The color of LEDs can be uniform or varied as a matter of design choice, and the types of light-emitting sources 22 used on any particular rotating member 20 can be mixed as a matter of design choice.

As previously discussed, the controller 44 may control both variations in the rotational speed of the rotating member 20 as well as the frequency and/or intensity of the light-emitting sources 22, or any combination thereof as a matter of application-specific design choice. The variations in rotational speed and/or lighting frequency or intensity create optically pleasing effects as the rotating member 20 rotates about its axis. Specifically, in the preferred embodiment depicted in FIG. 1, when each of the light-emitting sources 22 are activated, the light-emitting sources 22 create an image of a three-dimensional sphere comprising six parallel multi-colored lines and a single rotating light at the top and at the bottom of the sphere. As the speed of rotation is varied, or when the intensity or actuation of the various light-emitting sources is altered, different effects are achieved, such as an appearance that the light-emitting sources are rotating in a direction opposite to the direction of rotation of the rotating member 20. Another effect achieved is an appearance of dashed lines comprising the sphere. Still another effect is the appearance that the light-emitting sources are slowing down or not rotating at all. As one of skill in the art will appreciate after considering the present invention, any number of other visual effects are envisioned without departing from the spirit of the present invention, including, but not limited to, the appearance of letters, words, phrases, or sentences and the like in any language.

Figure 2:
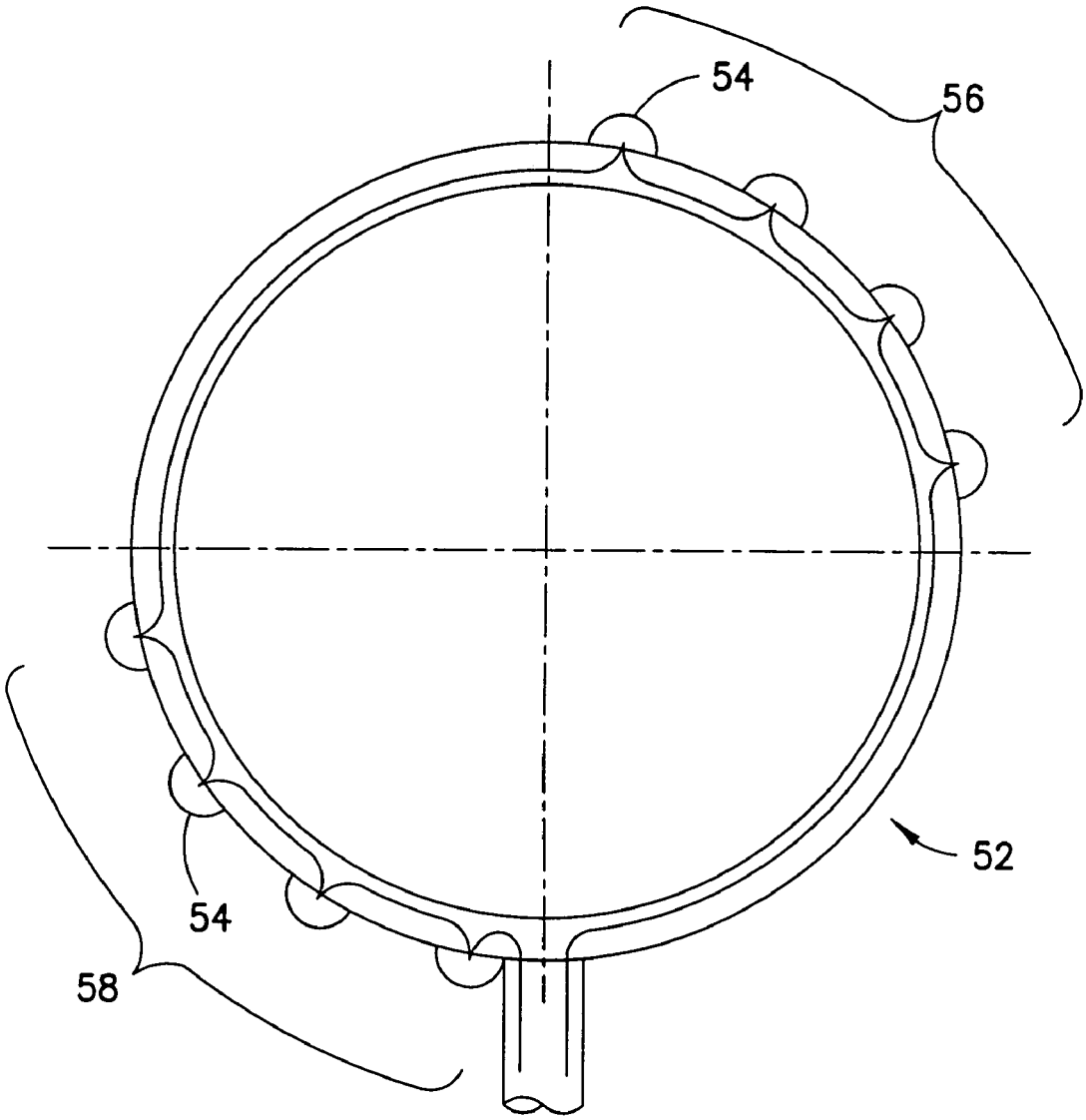
FIG. 2 is a schematic view of a portable light-emitting display device constructed in accordance with a second preferred embodiment of the present invention.

FIG. 2 depicts a second preferred embodiment of the present invention wherein the rotating member 52 is a single rotating member in the shape of a circular hoop and wherein the light-emitting sources 54 are LEDs mounted along portions that comprise the 0° to 90° arc 56 and the 180° to 270° arc 58 of the rotating member 52. In this embodiment, by way of example, four LEDs are mounted equidistant along the 0° to 90° arc 56 along the outer periphery of the rotating member 52. An additional four LEDs are mounted equidistant along the 180° to 270° arc 58 along the outer periphery of the rotating member 52. In light of this specification, it will be obvious to one skilled in the art how different optical effects, like the ones described above with respect to FIG. 1, can be achieved by arranging the LEDs or other light-emitting sources as depicted in FIG. 3 and by using the controller 44 for varying the rotational speed of rotating hoop 52 and/or varying the lighting sequences and/or intensities associated with the LEDs.

Figure 3:
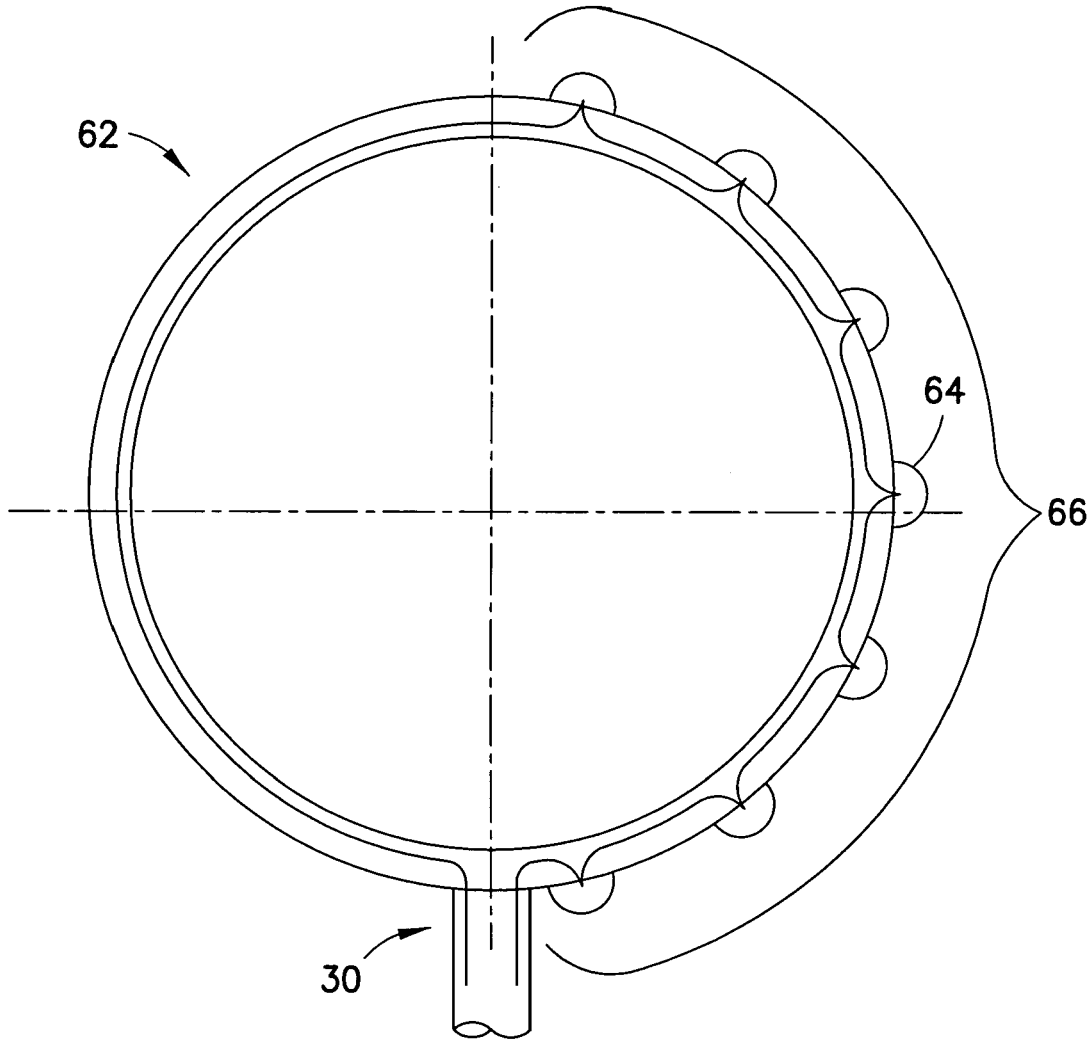
FIG. 3 is a schematic view of a portable light-emitting display device constructed in accordance with a third preferred embodiment of the present invention.

FIG. 3 depicts a third preferred embodiment of the present invention wherein the rotating member 62 is a single circular hoop and wherein the light-emitting sources 64 are LEDs mounted equidistant along the outer periphery of one half of the hoop, e.g., along portions that comprise the 0° to 180° arc 66 of the rotating hoop 62. In this embodiment, by way of example, seven LEDs are mounted equidistant along the 0° to 180° arc 66 along the outer periphery of the rotating hoop 62. In light of this specification, it will be obvious to one skilled in the art how different optical effects, like the ones described above for FIGS. 1 and 2, can be achieved by arranging the light-emitting sources 64 as depicted in FIG. 3 and by using the controller 44 for varying the rotational speed of the rotating hoop 62 and/or varying the lighting sequences and/or intensities associated with the light-emitting sources 64.

Figure 4:
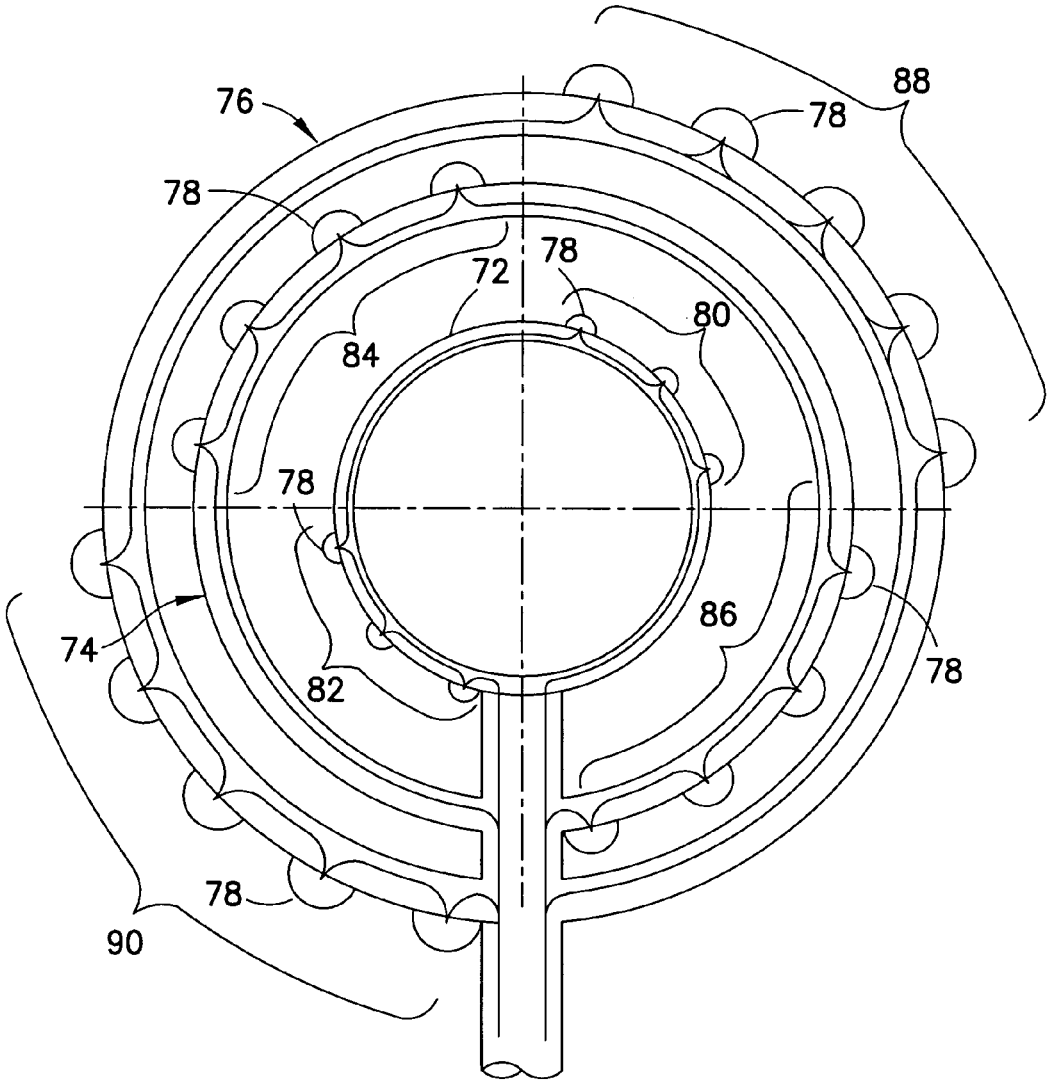
FIG. 4 is a schematic view of a portable light-emitting display device constructed in accordance with a fourth preferred embodiment of the present invention.

FIG. 4 depicts yet another preferred embodiment of the present invention where the light-emitting portion comprises a series of concentric hoops of increasing radius onto which light-emitting sources are mounted or otherwise affixed thereto. In this preferred embodiment, the rotating members comprise three concentric hoops 72, 74, 76, each having a plurality of the light-emitting sources 78 equidistantly mounted thereon. In a preferred embodiment, the three concentric hoops form a single rotating member. By way of example, six LEDs are mounted along the outer periphery of the innermost hoop 72. As seen in FIG. 4, three of the six LEDs are mounted equidistant along the 0° to 90° arc 80 along the outer periphery of the innermost hoop 72 and the remaining three LEDs are mounted equidistant along the 180° to 270° arc 82 along the outer periphery of the innermost hoop 72. Similarly, by way of example, eight LEDs are mounted along the outer periphery of the middle hoop 74, four of which are mounted equidistant along the 90° to 180° arc 86 along the outer periphery of the middle hoop 74 and the remaining four LEDs are mounted equidistant along the 270° to 360° arc 84 along the outer periphery of the middle hoop 74. Finally, by way of example, ten LEDs are mounted along the outer periphery of the outer hoop 76, five of which are mounted equidistant along the 0° to 90° arc 88 along the outer periphery of the outer hoop 76 and the remaining five LEDs are mounted equidistant along the 180° to 270° arc 90 along the outer periphery of the outer hoop 76. In light of this specification, it will be obvious to one skilled in the art how different optical effects, like the ones described above for FIGS. 1, 2 and 3, can be achieved by arranging the light-emitting sources 78 as depicted in FIG. 4 and by using the controller 44 for varying the rotational speed of the concentric hoops 72, 74, and 76 and/or varying the lighting sequences and/or intensities associated with the light-emitting sources 78.

As one skilled in the art will recognize, FIGS. 1 through 4 of the present invention depict only a few of the many possible embodiments of the present invention. For example, the embodiments described in FIGS. 1–4 may readily be varied and combined to create combinations of the lighting effects previously described as well as to create lighting effects that appear as letters, words, or phrases in any language. As such, those skilled in the art will appreciate that the conception, upon which this disclosure is based, may readily be utilized as a basis for designing other structures, methods, and systems for carrying out one or more of the several purposes of the present invention. It is important, therefore, that the claims be regarded as including such equivalent constructions insofar as they do not depart from the spirit and scope of the present invention.

Thus, while there have been shown and described and pointed out novel features of the present invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

It is also to be understood that the following claims are intended to cover all of the generic and specific features of the invention herein described and all statements of the scope of the invention, which, as a matter of language, might be said to fall there between. In particular, this invention should not be construed as being limited to the dimensions, proportions or arrangements disclosed herein.

What is claimed is:

1. A portable light-emitting display device comprising:

a rotating member in the shape of a hoop, said hoop having a plurality of light-emitting diodes mounted or otherwise affixed thereto; said rotating member coupled to a motor;

a power source comprising one or more conventional batteries;

said motor and said plurality of light-emitting diodes coupled to an integrated circuit, said integrated circuit controlling the lighting frequency and/or intensity of said plurality of light-emitting diodes and the rotary speed of said rotating member, or any combination thereof, to create a visual effect.

2. The device of claim 1 wherein said plurality of light-emitting diodes are mounted or otherwise affixed to said rotating member equidistant along the periphery of said rotating member.

3. The device of claim 1 further comprising a switch electrically coupled between said power source and said motor.

4. The device of claim 1 further comprising a housing to enclose said rotating member, said motor, and said integrated circuit.

5. The device of claim 1 wherein said housing comprises a transparent spherical cover to enclose said rotating member.

6. The device of claim 1 wherein said housing comprises a handle assembly for housing said motor, said integrated circuit and said power source.

7. The device of claim 1 wherein said visual effect comprises the appearance of a three-dimensional sphere.

8. The device of claim 1 wherein said visual effect comprises the appearance of said light-emitting diodes moving in a direction opposite to the direction of rotation of said rotating member.

9. The device of claim 1 wherein said visual effect comprises the appearance of said light-emitting diodes slowing in movement.

10. The device of claim 1 wherein said visual effect comprises the appearance of said light-emitting diodes not moving.

11. The device of claim 1 wherein said rotating member comprises a plurality of concentric hoops, said concentric hoops each having a plurality of light-emitting diodes mounted or otherwise affixed thereto.

12. The device of claim 11 wherein said visual effect comprises the appearance of a plurality of three-dimensional spheres.

13. The device of claim 11 wherein said visual effect comprises the appearance of said light-emitting diodes moving in a direction opposite to the direction of rotation of said plurality of concentric hoops.

* * * * *